US006695622B2

(12) United States Patent
Korsunsky et al.

(10) Patent No.: US 6,695,622 B2
(45) Date of Patent: Feb. 24, 2004

(54) ELECTRICAL SYSTEM HAVING MEANS FOR ACCOMMODATING VARIOUS DISTANCES BETWEEN PC BOARDS THEREOF MOUNTING THE MEANS

(75) Inventors: Iosif R. Korsunsky, Harrisburg, PA (US); Robert W. Brown, Harrisburg, PA (US); Wei-Chen Lee, Harrisburg, PA (US); Joanne E. Shipe, Harrisburg, PA (US); Kevin E. Walker, Hershey, PA (US); Tod M. Harlan, Mechanicsburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/159,459

(22) Filed: May 31, 2002

(65) Prior Publication Data

US 2003/0224628 A1 Dec. 4, 2003

(51) Int. Cl.[7] ..... H01R 12/00

(52) U.S. Cl. ..... 439/65; 439/79; 439/631; 439/638

(58) Field of Search ..... 439/65, 79, 74, 439/284, 286, 374, 630, 631, 636, 638

(56) References Cited

U.S. PATENT DOCUMENTS

| | | | | | |
|---|---|---|---|---|---|
| 4,686,607 | A | * | 8/1987 | Johnson | 361/788 |
| 5,098,311 | A | * | 3/1992 | Roath et al. | 439/295 |
| 5,137,462 | A | * | 8/1992 | Casey et al. | 439/74 |
| 5,647,749 | A | * | 7/1997 | Atoh et al. | 439/79 |
| 6,341,966 | B1 | * | 1/2002 | Takada et al. | 439/108 |
| 6,497,579 | B1 | * | 12/2002 | Garbini | 439/63 |

* cited by examiner

*Primary Examiner*—Hien Vu
(74) *Attorney, Agent, or Firm*—Wei Te Chung

(57) ABSTRACT

An electrical system (1) includes a number of PC boards (10, 12), a same number of electrical connectors (14, 16), and a half number of extenders (18, 20, 22) provided in sets. Each set includes two PC boards, two electrical connectors mounted onto respective PC boards and one extender located between and engaging with the two electrical connectors. There are extenders that have various heights so that extenders of different heights mating with the electrical connectors establish various distances between the PC boards mounting the electrical connectors.

6 Claims, 19 Drawing Sheets

ELECTRICAL SYSTEM HAVING MEANS FOR ACCOMMODATING VARIOUS DISTANCES BETWEEN PC BOARDS THEREOF MOUNTING THE MEANS

BACKGROUND OF THE INVENTION

1. Field of the Invention

The present invention relates to an electrical system having means for accommodating various distances between PC boards thereof connecting the means, the means including connectors mounted onto respective PC boards and extenders engageable with the connectors. The extenders may have various heights so as to, using a particular extender to mate with connectors, establish the specific distance between the PC boards.

2. Description of the Related Art

Currently, board mountable connectors are widely used to establish electrical connections between two separated printed circuit boards (PCBs). Usually, there are two connectors, a plug connector and a receptacle connector, respectively mounted onto the PCBs and engageable with each other. The board mountable connectors between the PCBs function as not only a connecting device but also a device for standing off the printed circuit boards predetermined distances. In different conditions, the distances may be different. To meet this requirement, either the plug connectors or the receptacle connectors or both are manufactured to have different heights. This is not an effective and economical solution because the plug or receptacle connectors of different heights should be manufactured in different molds and dies, which increases their cost. One solution for the above issue is to provide two identical board mountable connectors respectively mounted on mother board and daughter board, and extenders of various heights that are engageable with the board mountable connectors. Using a particular extender to engage with the two board mountable connectors defines a particular distance between the mother board and the daughter board. However, the extenders each include an insulative housing, being generally "H-shaped", and a plurality of conductive contacts received in cavities defined in the housing. When an extender is needed for a high stack height application, the contacts are usually long. This results in a difficulty of inserting the contacts into the cavities of the housing without damage. This invention is a method to provide an effective and economical solution for the requirement of different board to board distances.

SUMMARY OF THE INVENTION

A first object of the present invention is to provide an electrical system having means for accommodating various distances between printed circuit boards connecting the means in an effective and economical way;

A second object of the present invention is to provide an extender having modular terminal inserts for facilitating the manufacturing of the extender.

To obtain the above object, an electrical system includes a first and a second printed circuit board (PCB), a first and a second electrical connector and multiple extenders of different heights. The first and the second electrical connector are respectively mounted onto the first and the second PCB and the extenders one at a time located between and electrically engaging with the first and the second electrical connector. Using a particular extender to mate with the first and the second electrical connector separates the first PCB a specific distance from the second PCB.

The electrical connectors mounted onto the respective PCBs are preferably identical. Each extender includes an insulative body, pairs of terminal modules assembled to the insulative body. Each terminal module includes a dielectric base and a plurality of signal contacts and a plurality of grounding contacts or grounding blades respectively attached to opposite surfaces of the dielectric base. The extenders of various heights can be manufactured in the same molds and dies, and the heights thereof may be controlled by adding tooling into the molds and dies or removing tooling from the molds and dies.

Other objects, advantages and novel features of the invention will become more apparent from the following detailed description of the present embodiment when taken in conjunction with the accompanying drawings.

DESCRIPTION OF THE PREFERRED EMBODIMENT

Figure 1:
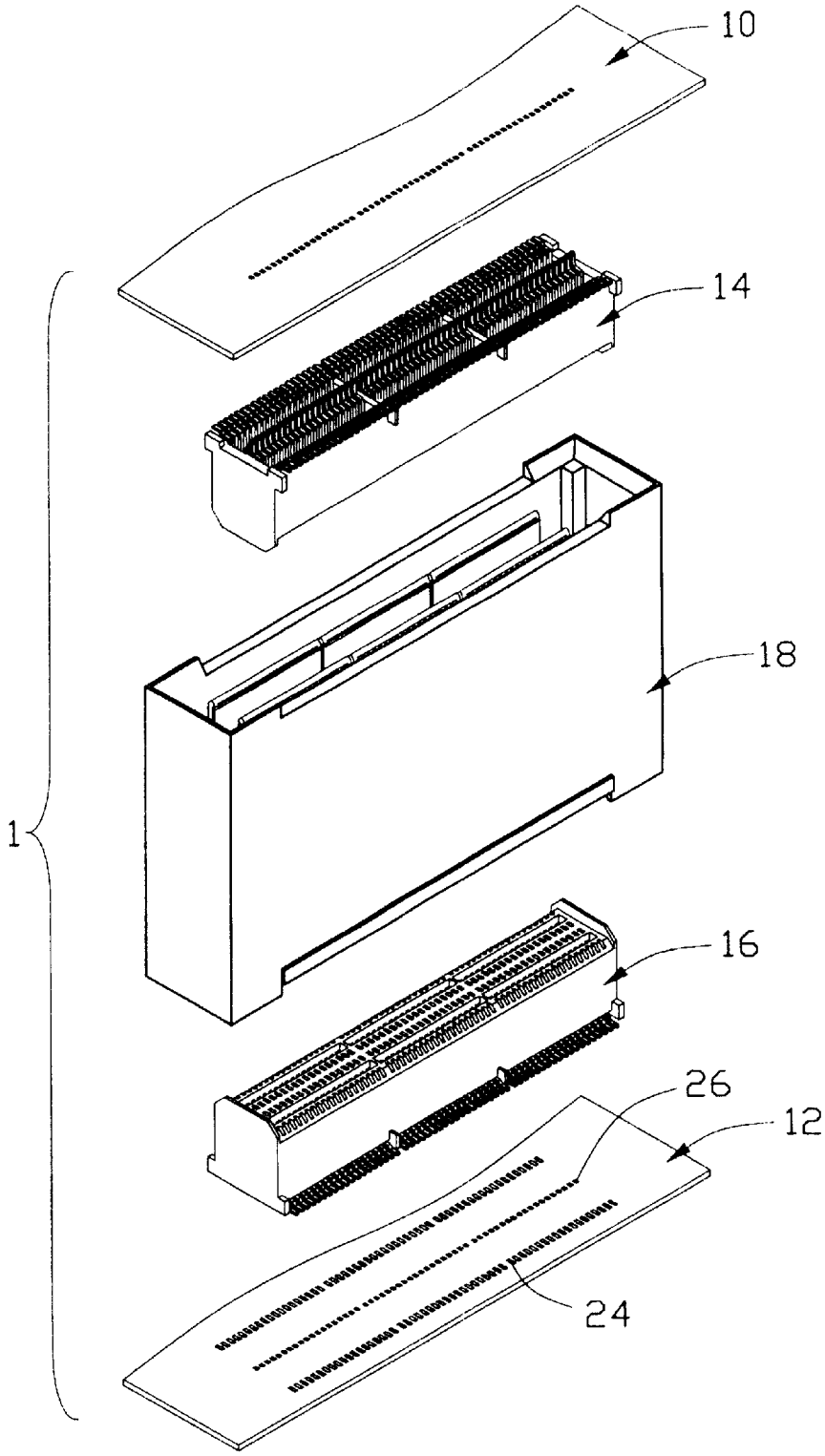
FIG. 1 is an exploded perspective view of an electrical system of the present invention which includes two PC boards, two electrical connectors and a first extender between the two connectors.
Figure 2:
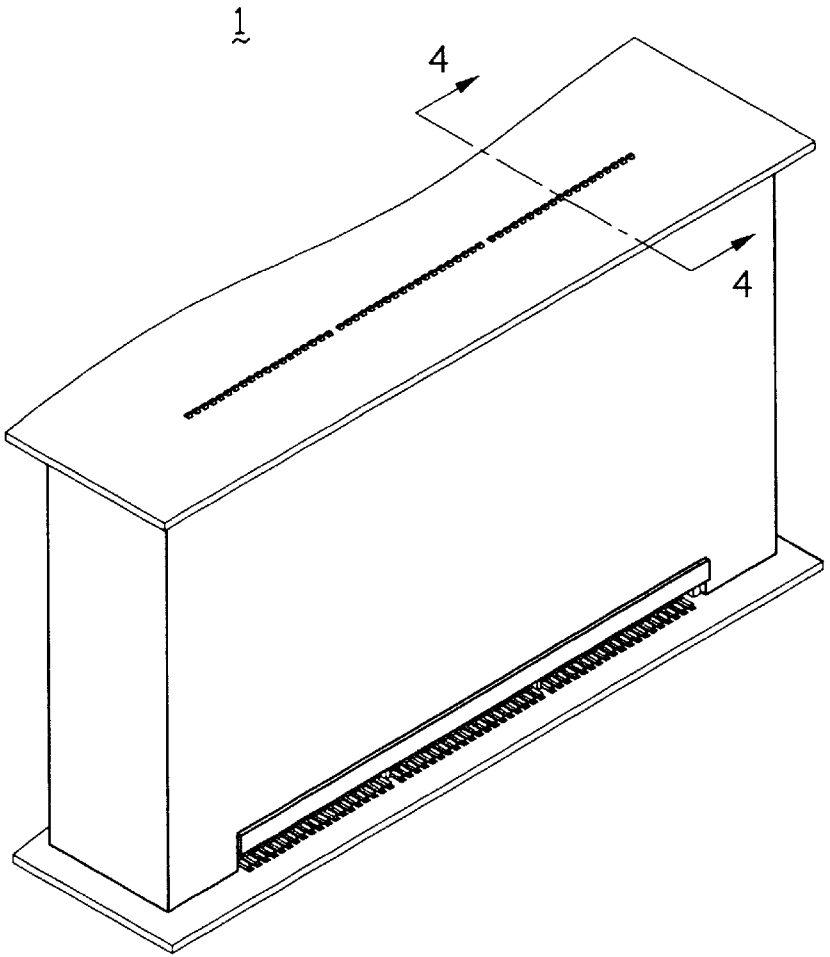
FIG. 2 is an assembled view of FIG. 1.
Figure 3:
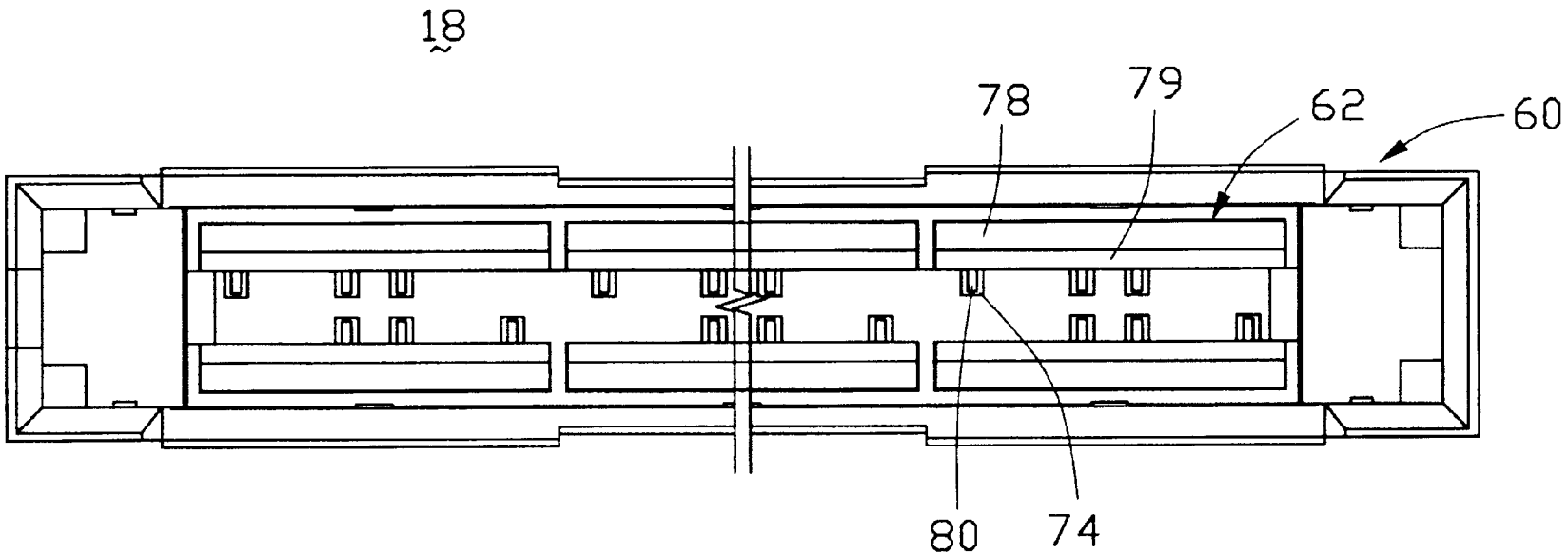
FIG. 3 is a top view of the first extender in FIG. 1.
Figure 4:
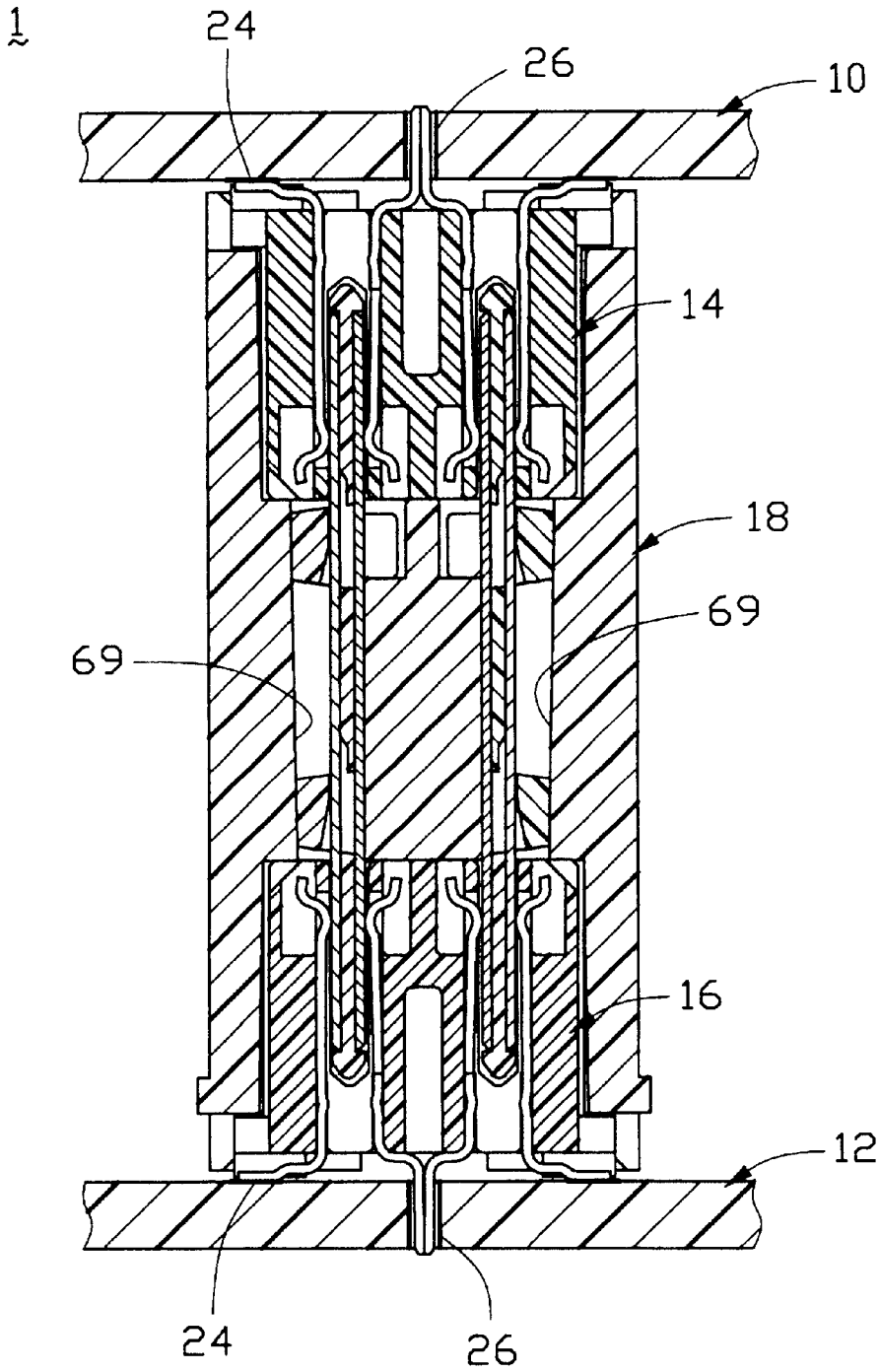
FIG. 4 is a cross-sectional view taken along line 4—4 of FIG. 2, wherein the two PC boards are offset a first distance by the first extender.
Figure 5:
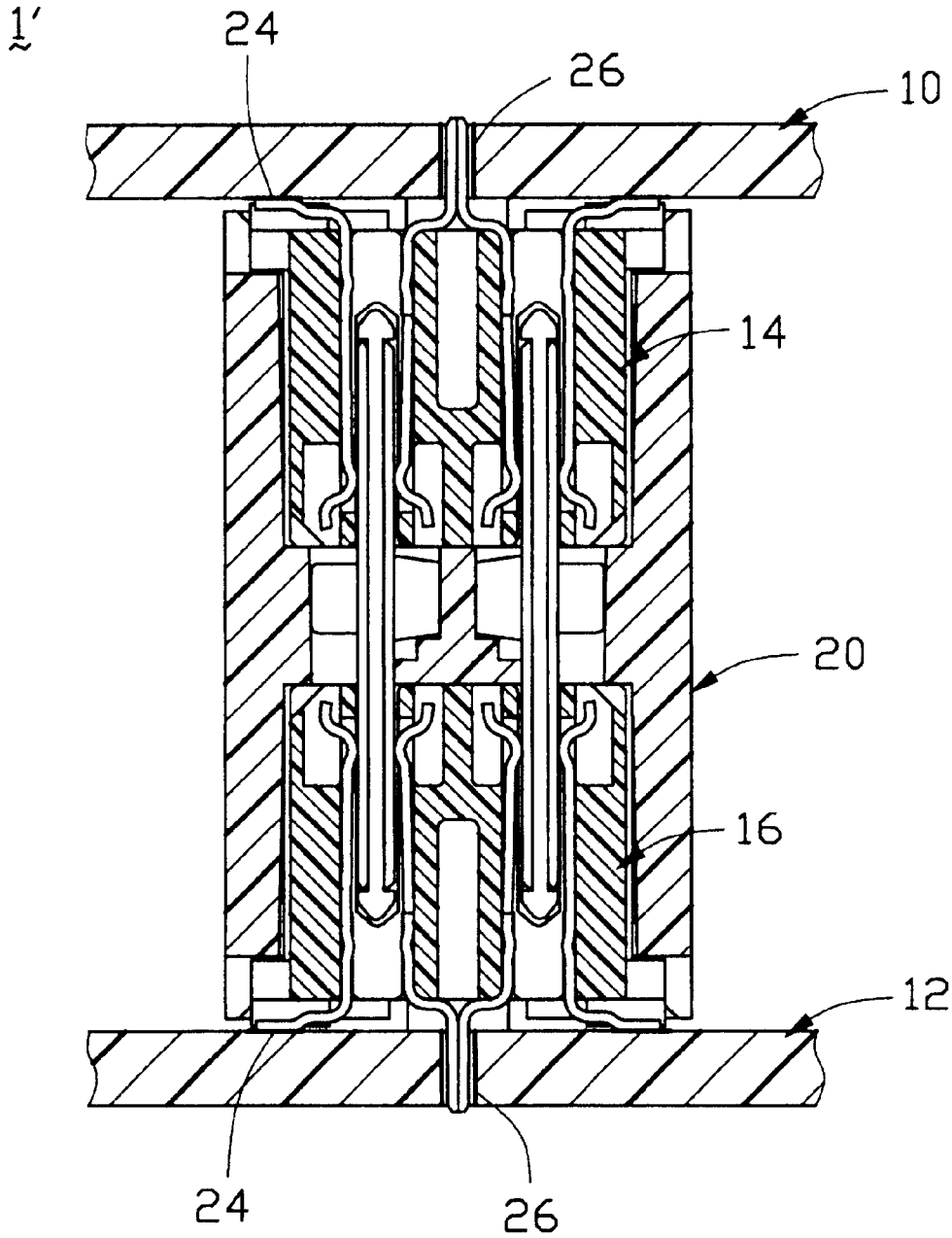
FIG. 5 is a view similar to FIG. 4 but the two PC boards are offset a second distance by a second extender.
Figure 6:
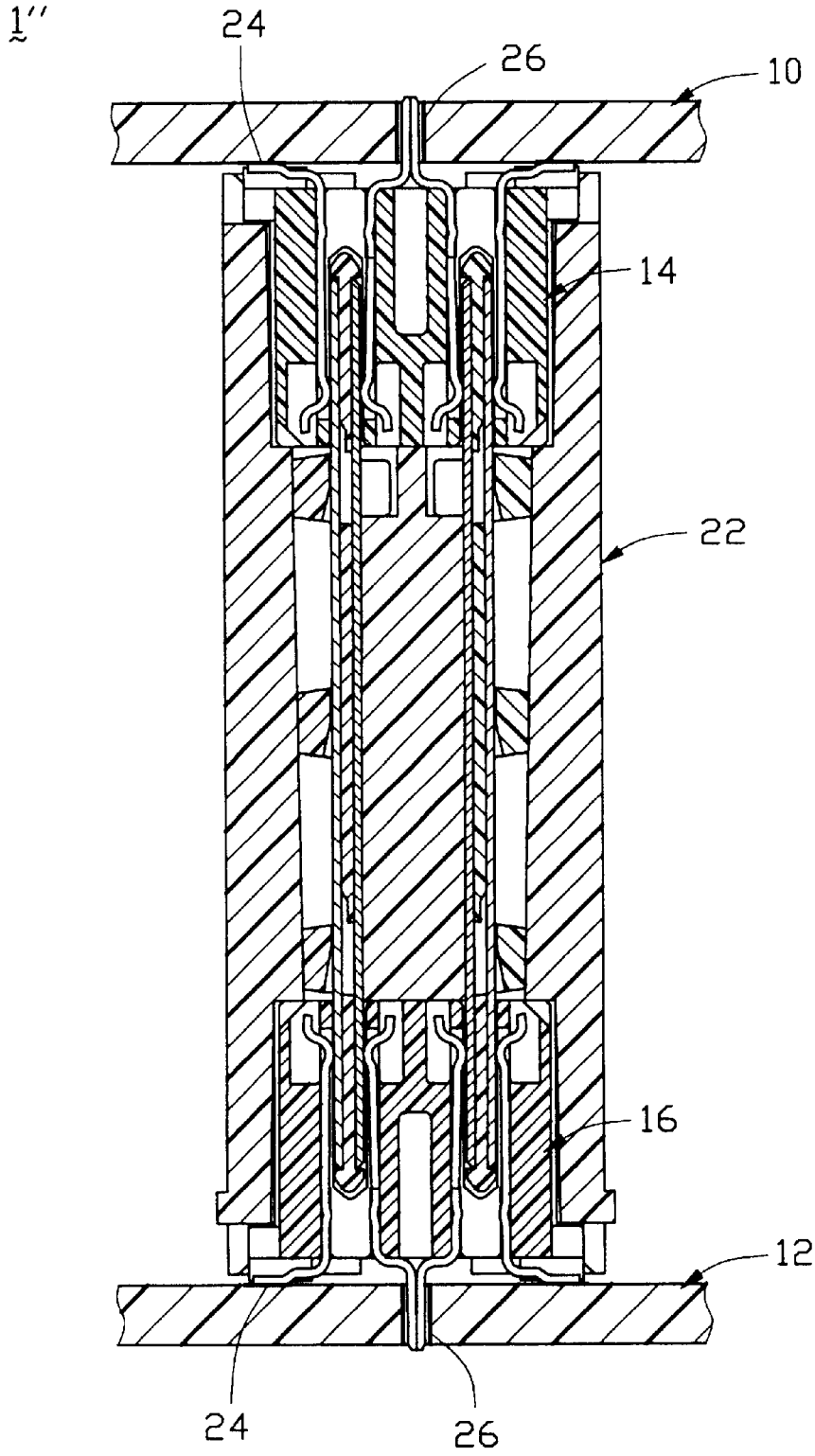
FIG. 6 is a view similar to FIG. 4 but the two PC boards are offset a third distance by a third extender.
Figure 7:
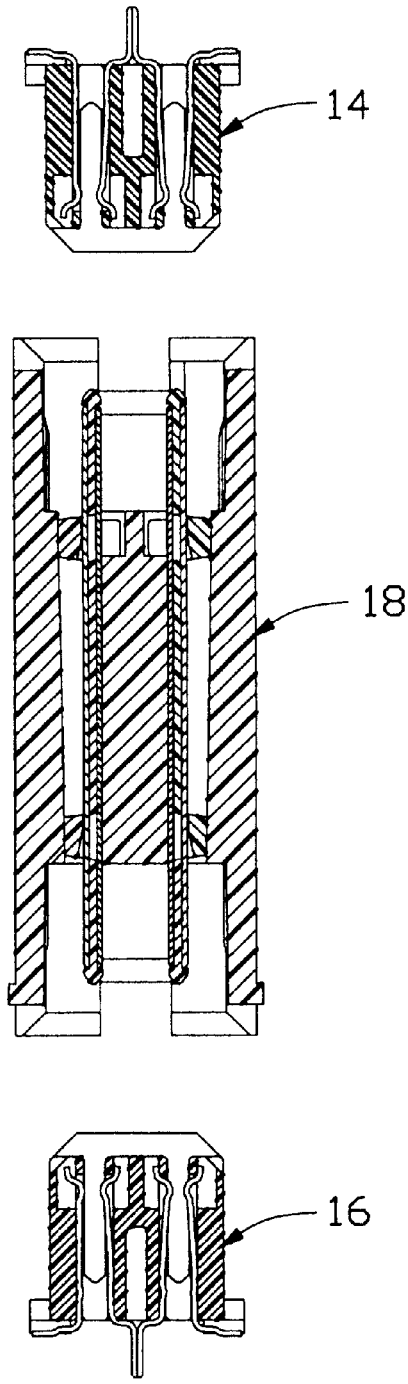
FIG. 7 is a view similar to FIG. 4 but the two electrical connectors are disengaged from the first extender and the two PC boards are removed therefrom.
Figure 8:
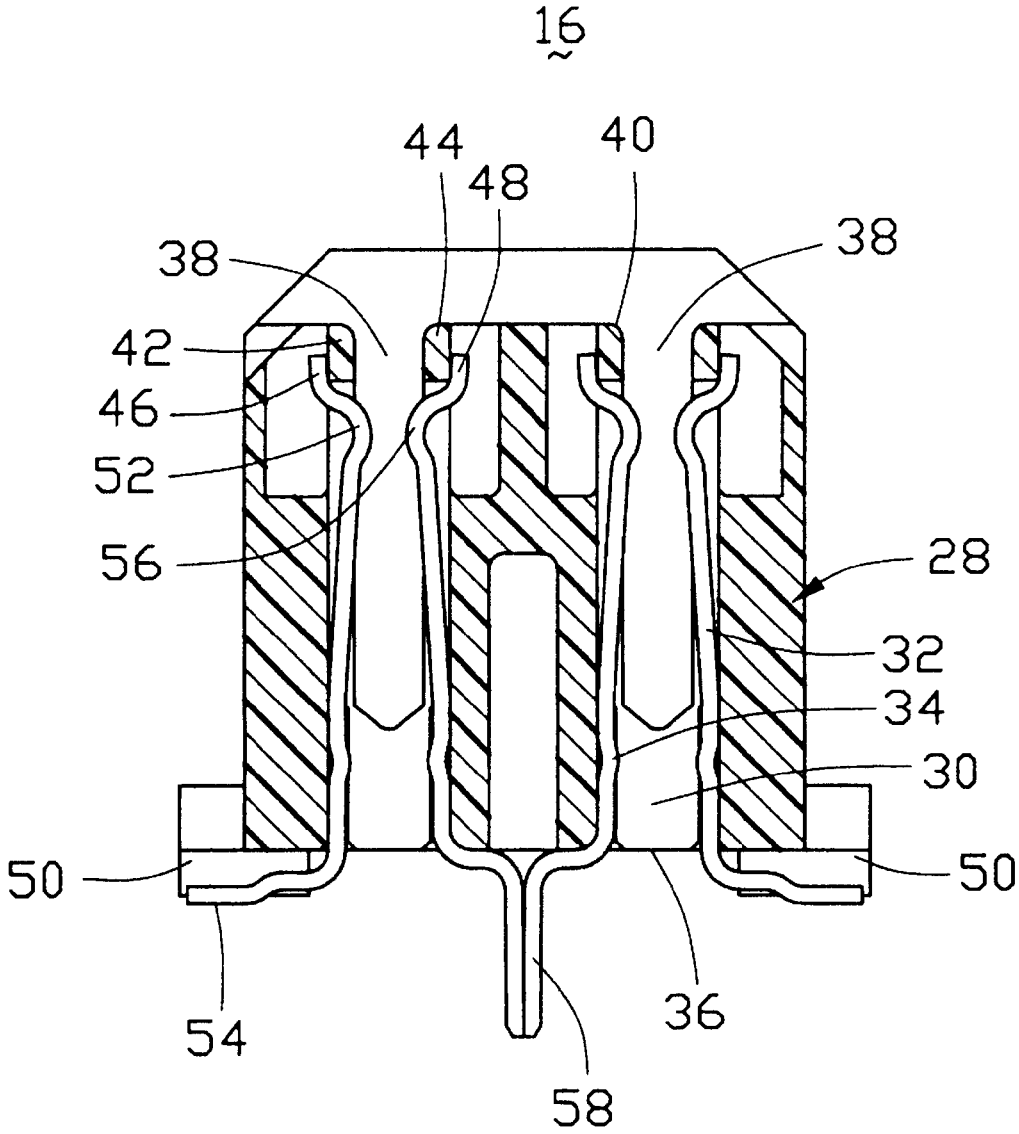
FIG. 8 is an enlarged cross-sectional view of one of the electrical connectors.
Figure 9:
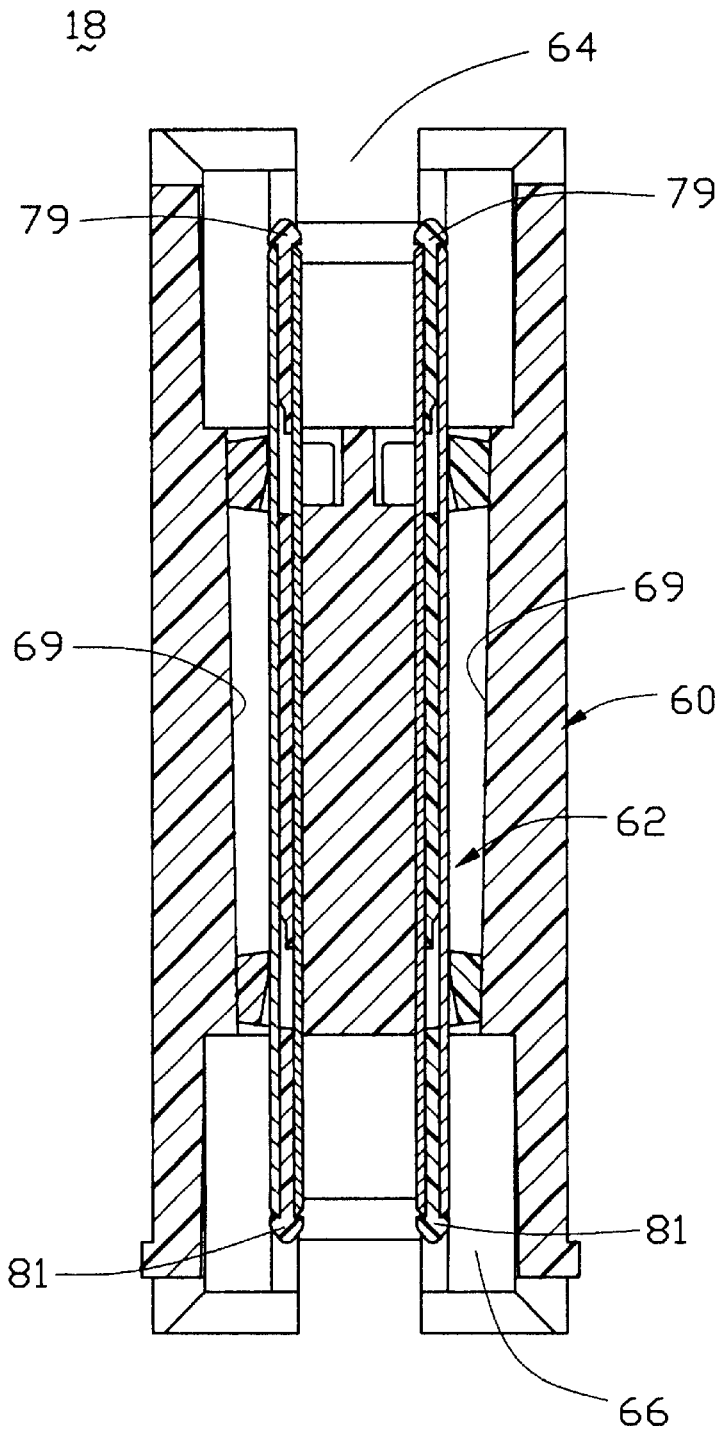
FIG. 9 is an enlarged cross-sectional view of the first extender.
Figure 10:
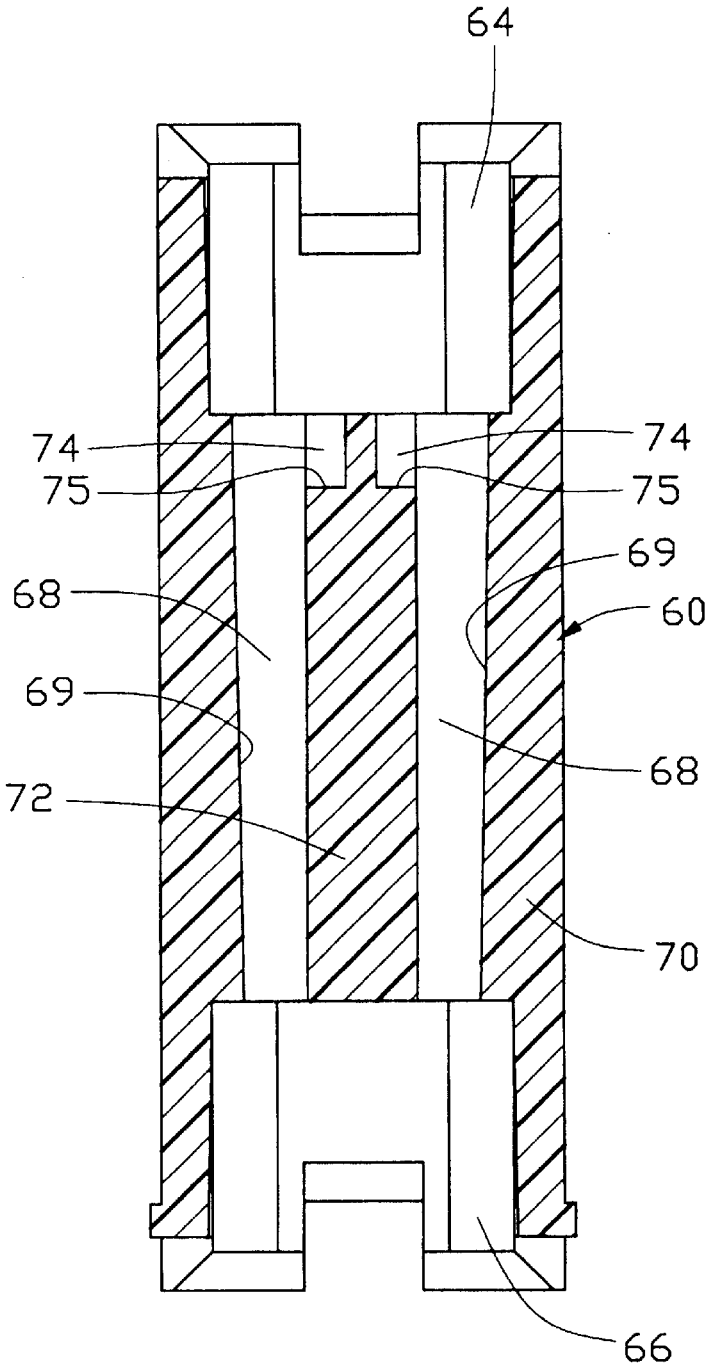
FIG. 10 is an enlarged cross-sectional view of an insulative body of the first extender.
Figure 11:
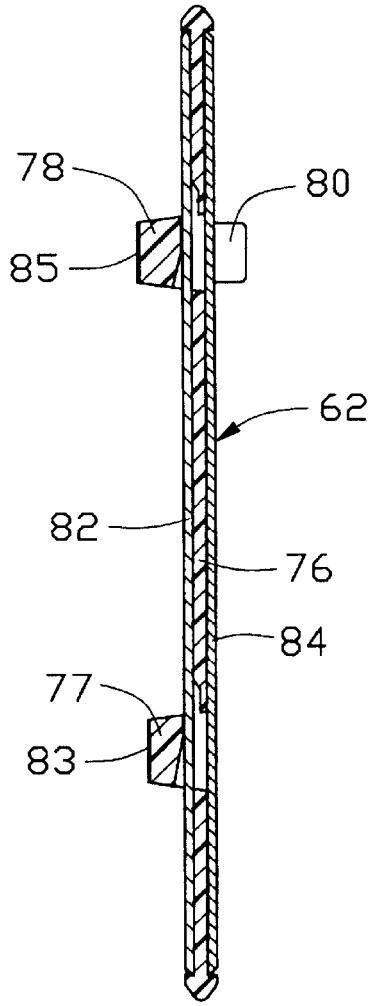
FIG. 11 is an enlarged cross-sectional view of a terminal module of the first extender.

Referring to FIGS. 1–6, an electrical system of the present invention includes a first and a second PC board 10, 12, a first and a second electrical connector 14, 16 respectively mounted onto the first and the second PC board 10, 12 and a first, a second and a third extender 18, 20, 22 one at a time located between and electrically engageable with the first and the second connector 14, 16. The first, the second and the third extender 18, 20, 22 have various heights thereby, after mating with the first and the second connector 14, 16 one at a time, separating the first PC board 10 particular distances from the second PC board 12, respectively. Each of the first and the second PC board 10, 12 include two rows of conductive interconnects or solder pads 24 on one of two opposite surfaces thereof and a row of interconnects or plated through-holes 26 between the two rows of solder pads 24.

Referring to FIGS. 7–11, the first and the second connector 14, 16 are preferably the same in this invention. The second connector 16 includes an insulative housing 28 defining a plurality of cavities 30 aligned in two rows in a longitudinal direction thereof, a plurality of signal contacts 32 and a plurality of grounding contacts 34, wherein each cavity 30 receives one signal contact 32 and one grounding contact 34 arranged in a transversal direction of the housing 28. The cavities 30 in each row are communicated with each other at sections thereof away from a board mounting surface 36 of the housing 28 to define a slit 38 in a mating surface 40 for mating with the selected one of the first, the second and the third extender 18, 20, 22. The housing 28 provides two retaining ribs 42, 44 in each slit 38 adjacent the mating surface 40 which bear against tips 46, 48 of corresponding signal and grounding contacts 32, 34 to pre-load corresponding signal and grounding contacts 32, 34. The housing 28 provides four stand-offs 50 at four corners of the board mounting surface 36 thereof. The signal contacts 32 each have a contacting portion 52 adjacent the tip 46 extending into the slit 38 and a surface mount portion 54 extending beyond the board mounting surface 36 for mounting to the solder pad 24 of the PC board. The grounding contacts 34 each have a contacting portion 56 adjacent the tip 48 extending into the slit 38 and a tail portion 58 extending beyond the board mounting surface 36 for mounting to the through-holes 26 of the PC board. The tail portions 58 of the two rows of grounding contacts 34 in a same cross-sectional surface of the housing 28 are attached to each other and inserted into a same through-hole 26 of the PC board 12.

The first extender 18 includes an insulative body 60 and a pair of terminal modules 62 assembled to the insulative body 60. The insulative body 60 defines a first and a second mating ports 64, 66 in two opposite surfaces thereof and defines two slots 68 at a middle section 70 thereof communicating with the first and the second mating port 64, 66. The insulative body 60 has an inner portion 72 between the two slots 68 which defines two notches 74 adjacent the mating port 64 of the insulative body 60 and provides two shoulders 75 formed by peripheral walls of the notches 74. Each slot 68 has an oblique peripheral wall 69 away from the inner portion 72. The terminal module 62 includes a dielectric base 76 having an upper bias bar 78 and a lower bias bar 77 on one surface thereof, three ribs 80 (FIG. 3) on an opposite surface thereof, and a plurality of signal terminals 82 and a grounding blade 84 respectively attached onto the two opposite surfaces thereof. The grounding blade 84 may strengthen the terminal module 62. The upper bias bar 78 and the lower bias bar 77 respectively have inclined planes 85, 83 and the lower bias bar 77 is smaller than the upper bias bar 78 such that the terminal module 62 can be inserted into the slot 68 only in a particular direction. The two terminal modules 62 are fixedly received in the respective slots 68 of the insulative body 60 with opposite ends 79, 81 thereof extending into the mating ports 64, 66 and the ribs 80 are received in the notches 74 and supported by the shoulders 75 and the bias bars 78, 77 bear against the oblique peripheral walls 69 of the slots 68.

As noted above, the first, the second and the third extender 18, 20, 22 each have a different height. So, selecting a corresponding one of the extenders to mate with the first and the second connector 14, 16 will elevate the first PC board 10 a corresponding distance from the second PC board 12 without changing either the height of the first connector 10 or the second connector 12. The manufacture of the first, the second and the third extender 18, 20, 22 is convenient and low cost because they are produced from the same molds and dies. The locations of the V-cuts, where carrier strips are severed from, of the grounding blades 84 and the signal terminals 82 are changeable by adjusting the locations of the inserts in the stamping dies. The location changes of the V-cuts determine the lengths of the signal terminals 82 and the grounding blades 84. The insulative bodies 60 of the first, the second and the third extender 18, 20, 22 are molded in the same mold to have three different heights by adding or removing adjustable tooling in the mold.

Figure 12:
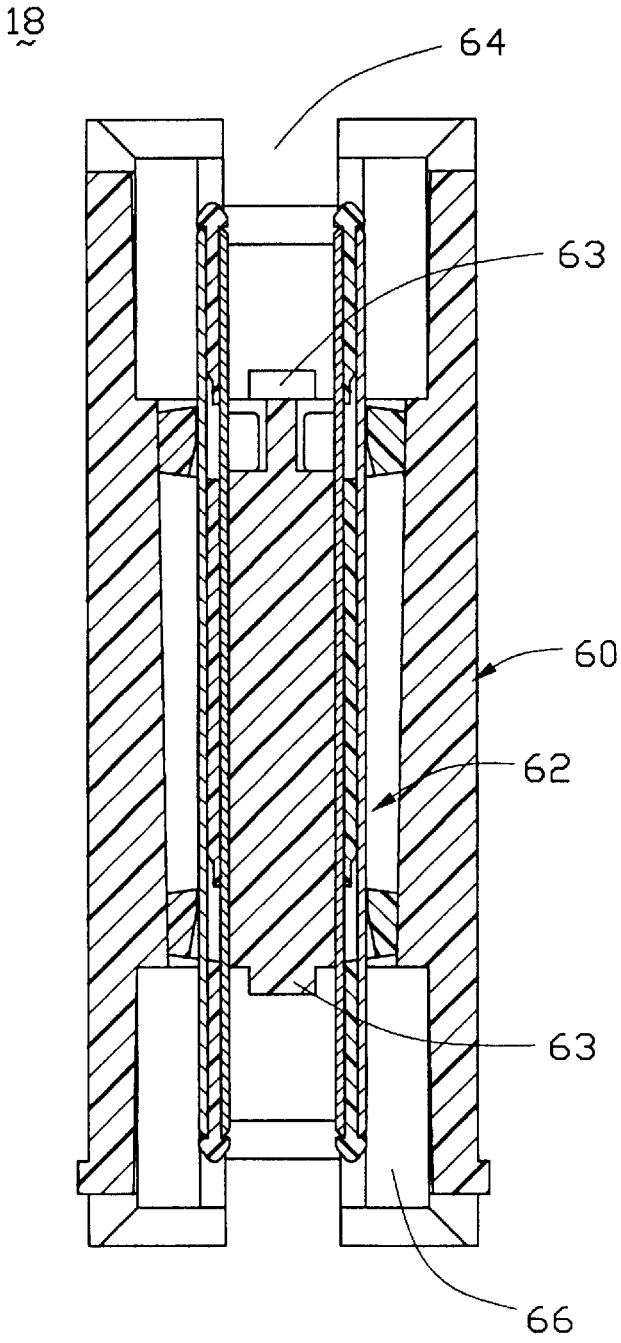
FIG. 12 is a cross-sectional view of the first extender of a second embodiment.
Figure 13:
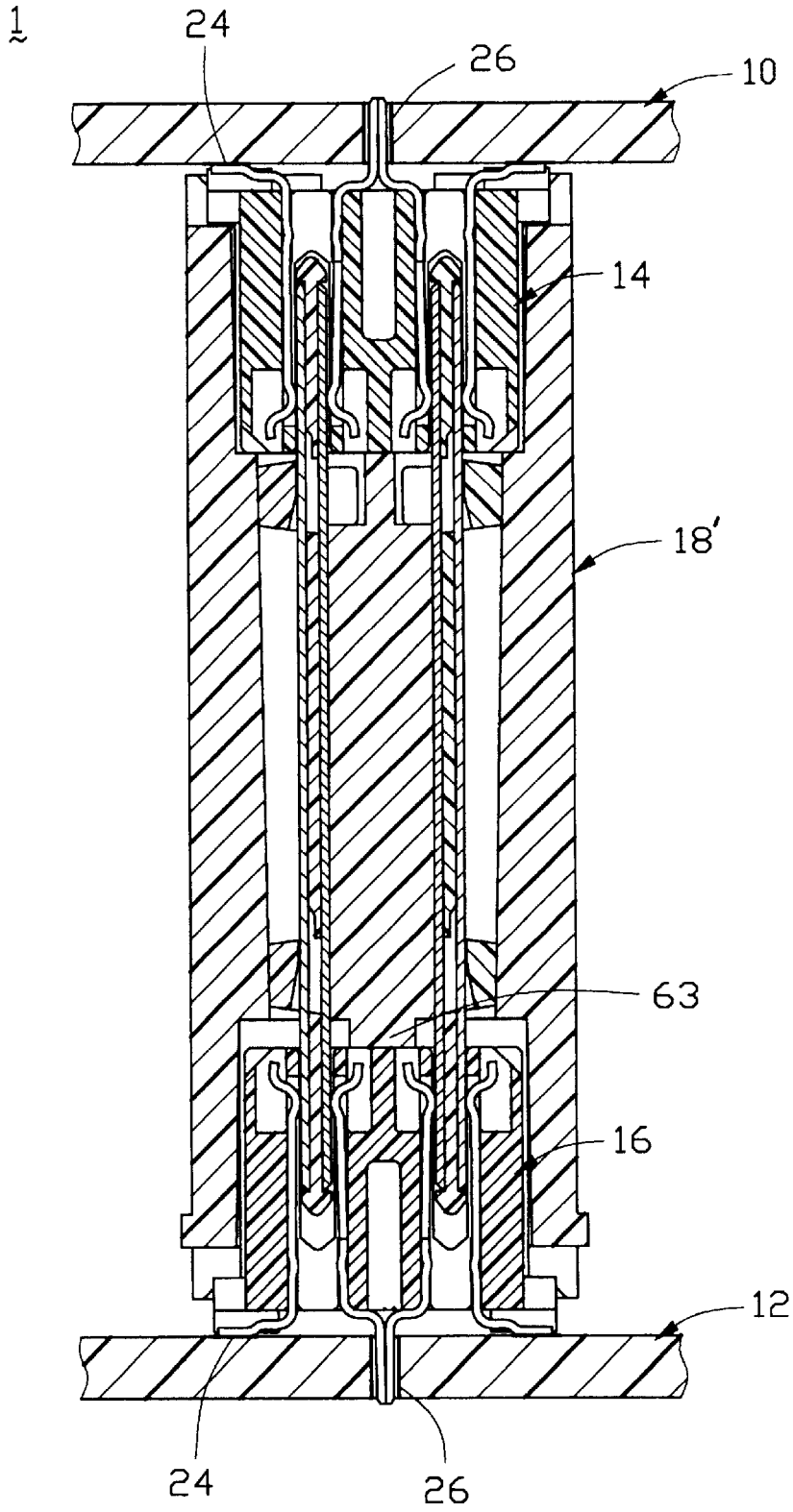
FIG. 13 is a cross-section view of an assembly of the first extender in FIG. 12 and the first and the second electrical connector.
Figure 14:
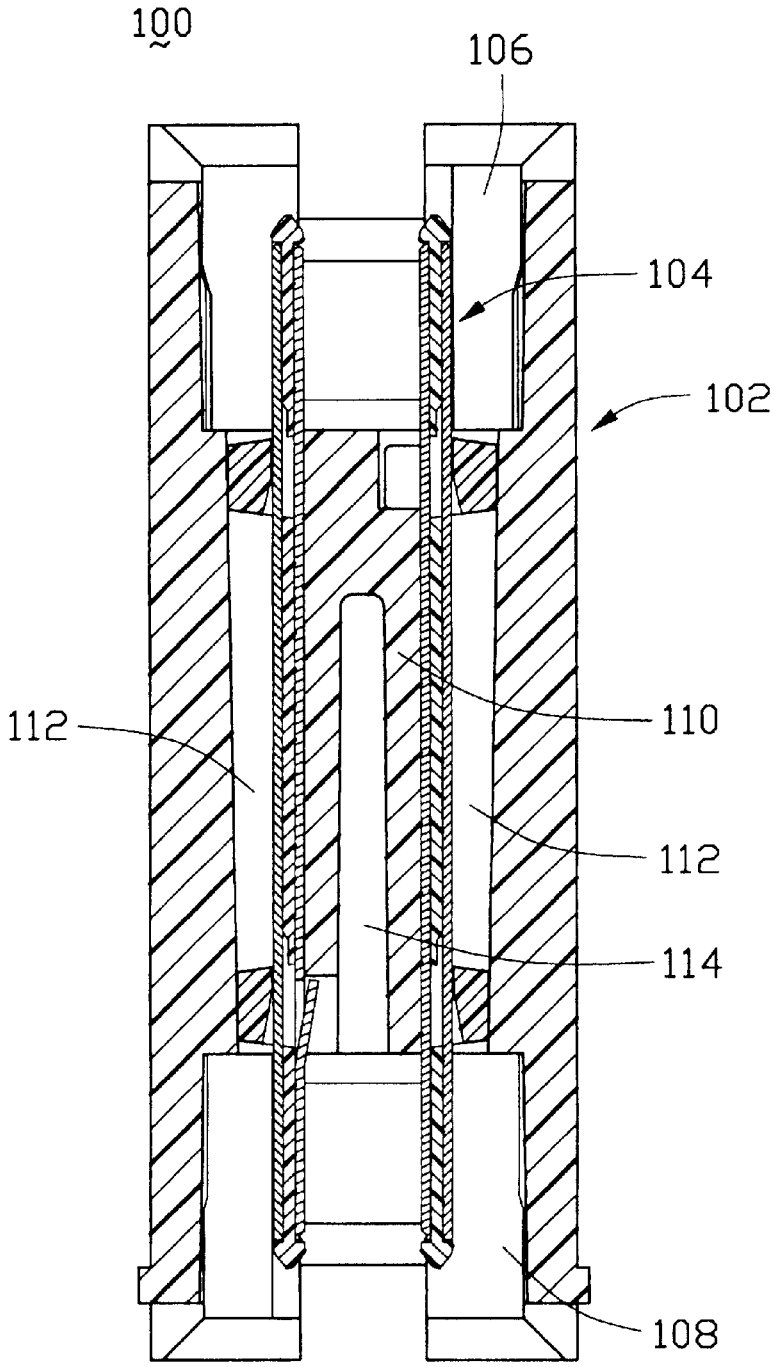
FIG. 14 is a cross-sectional view of the first extender of a third embodiment.
Figure 15:
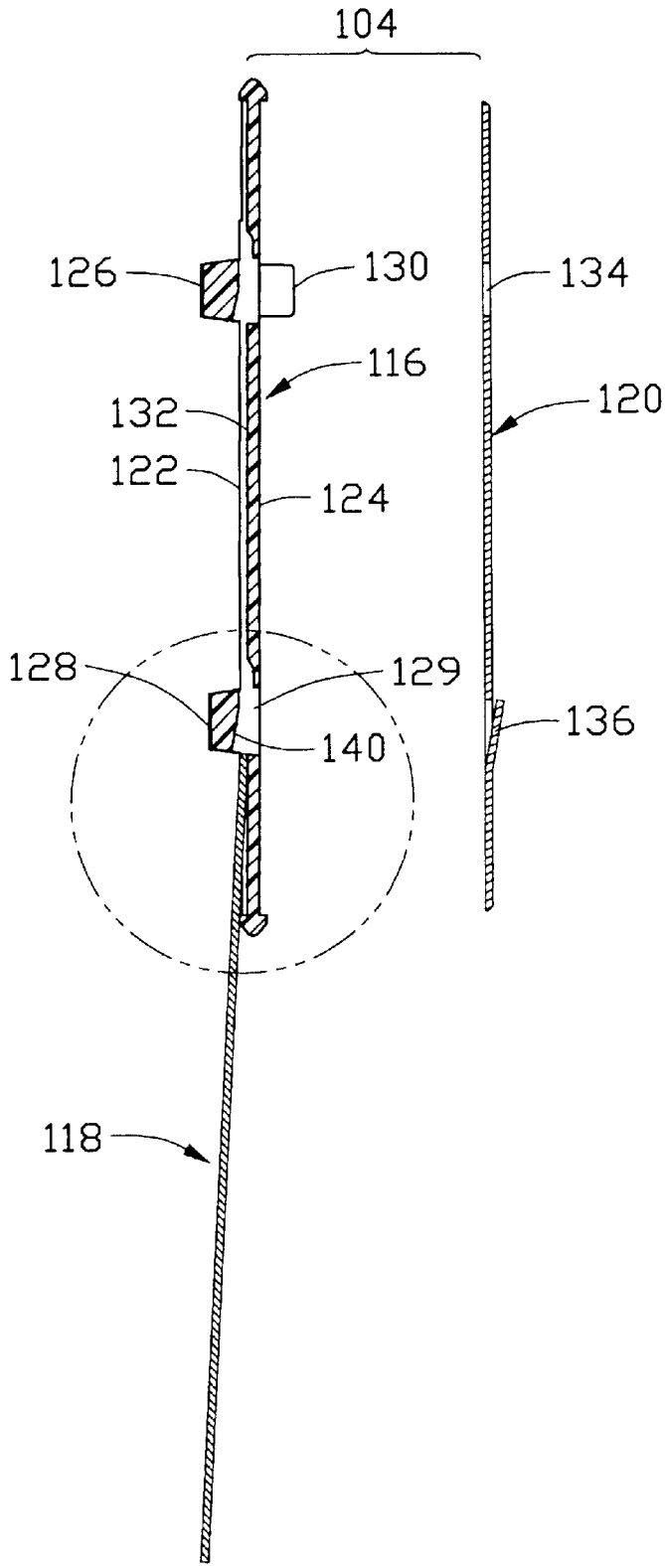
FIGS. 15–17 are enlarged cross-sectional views of the terminal module in FIG. 14.
Figure 16:
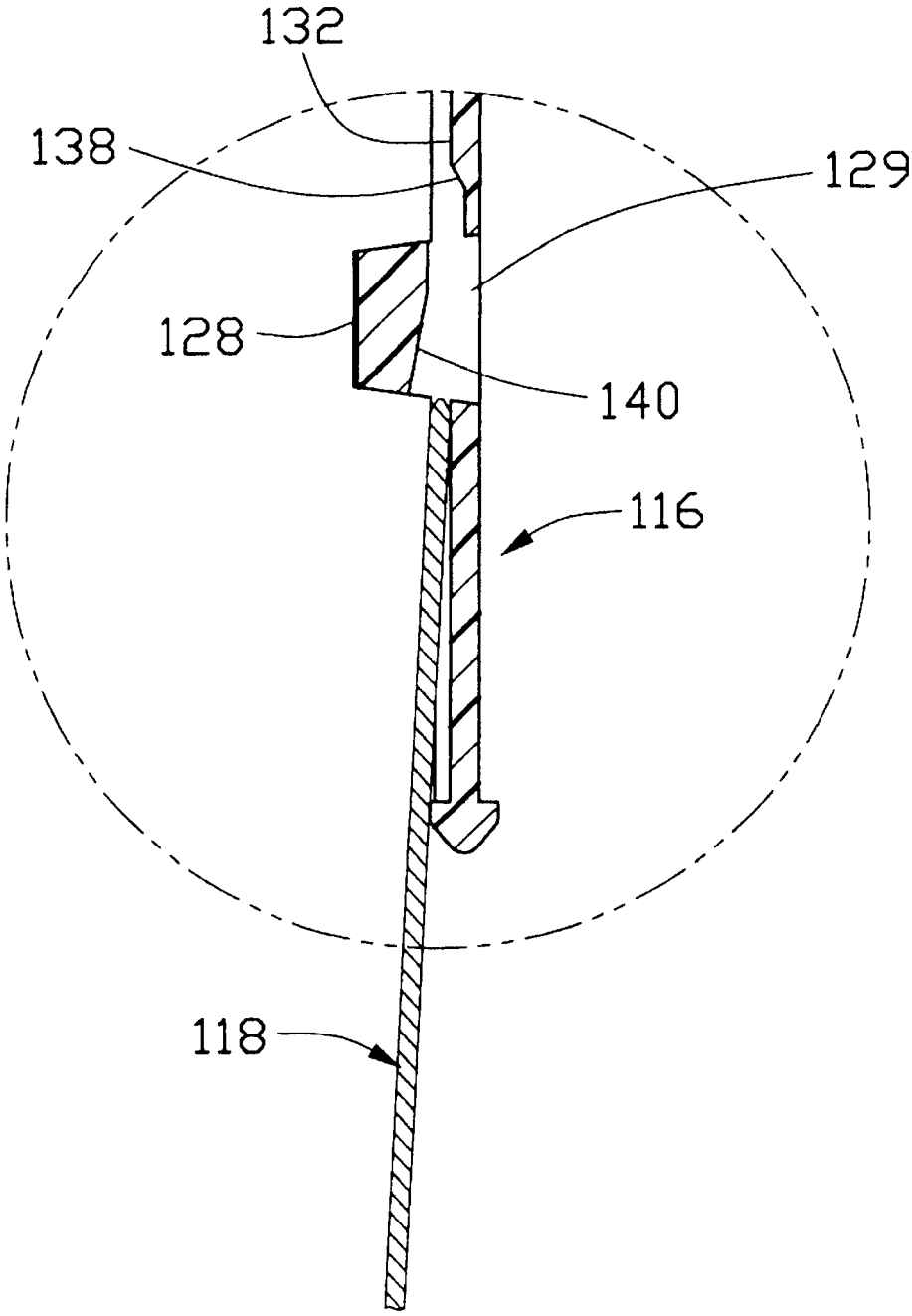
Figure 17:
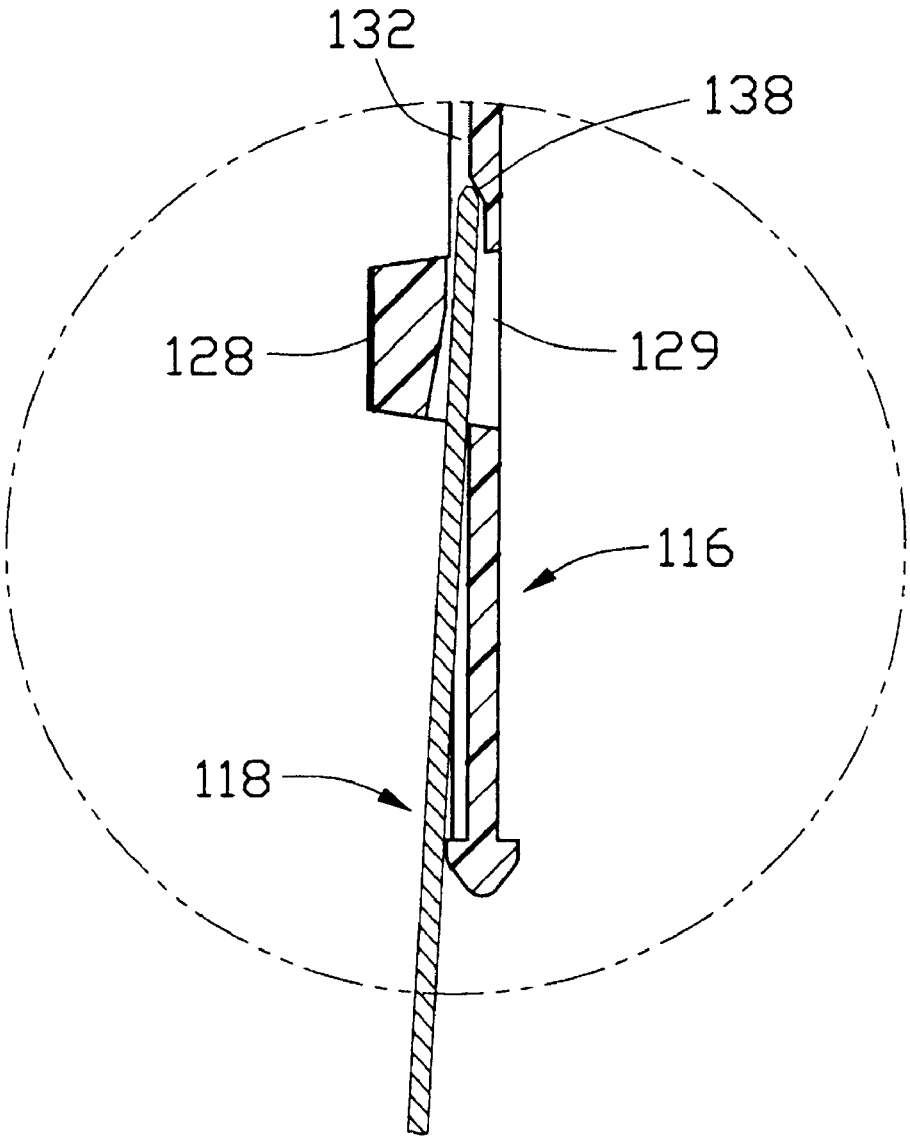
Figure 18:
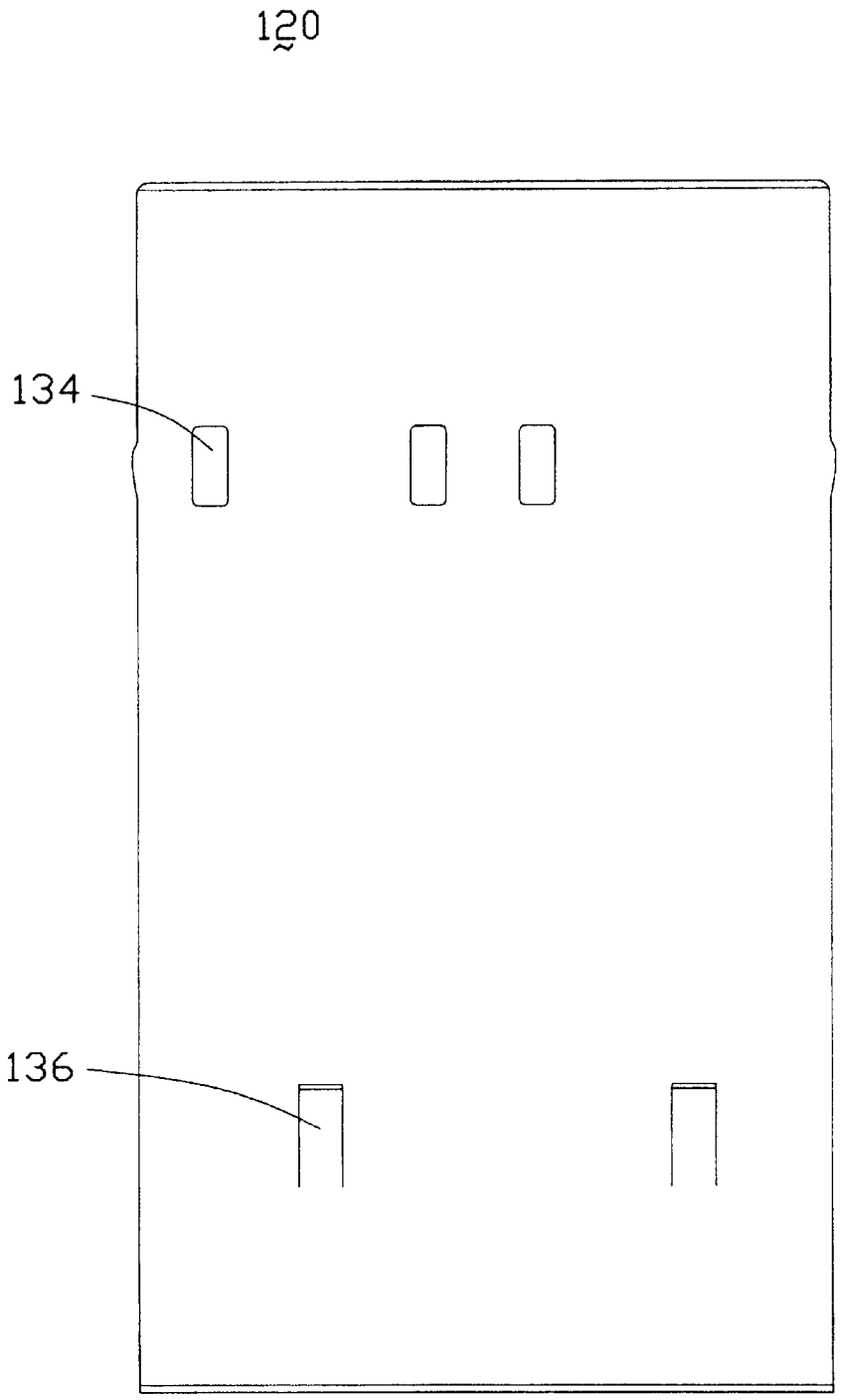
FIG. 18 is an enlarged planar view of the grounding plate in FIG. 15.
Figure 19:
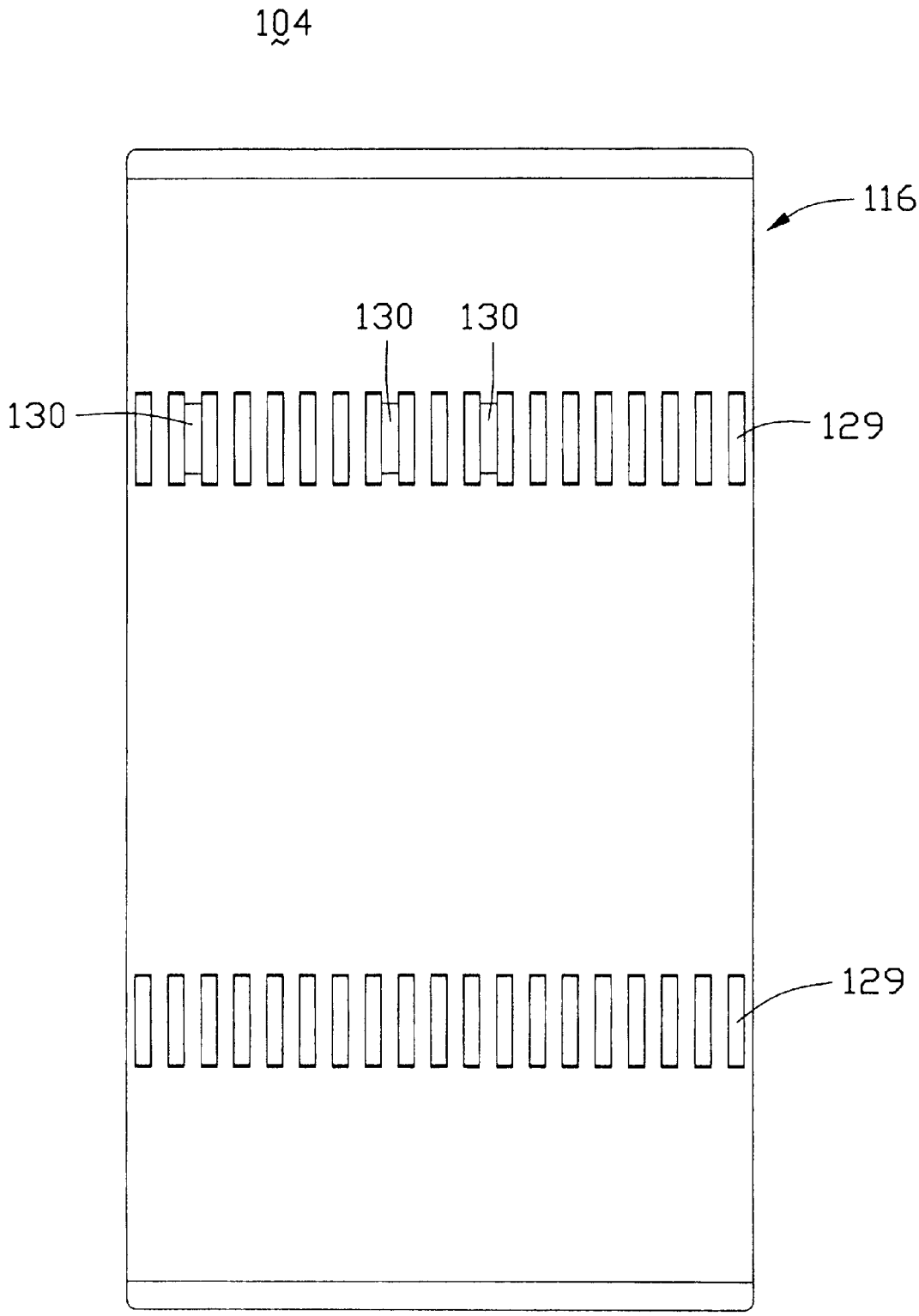
FIG. 19 is a planar view of the terminal module in FIG. 14 wherein the grounding blade is removed.
Figure 20:
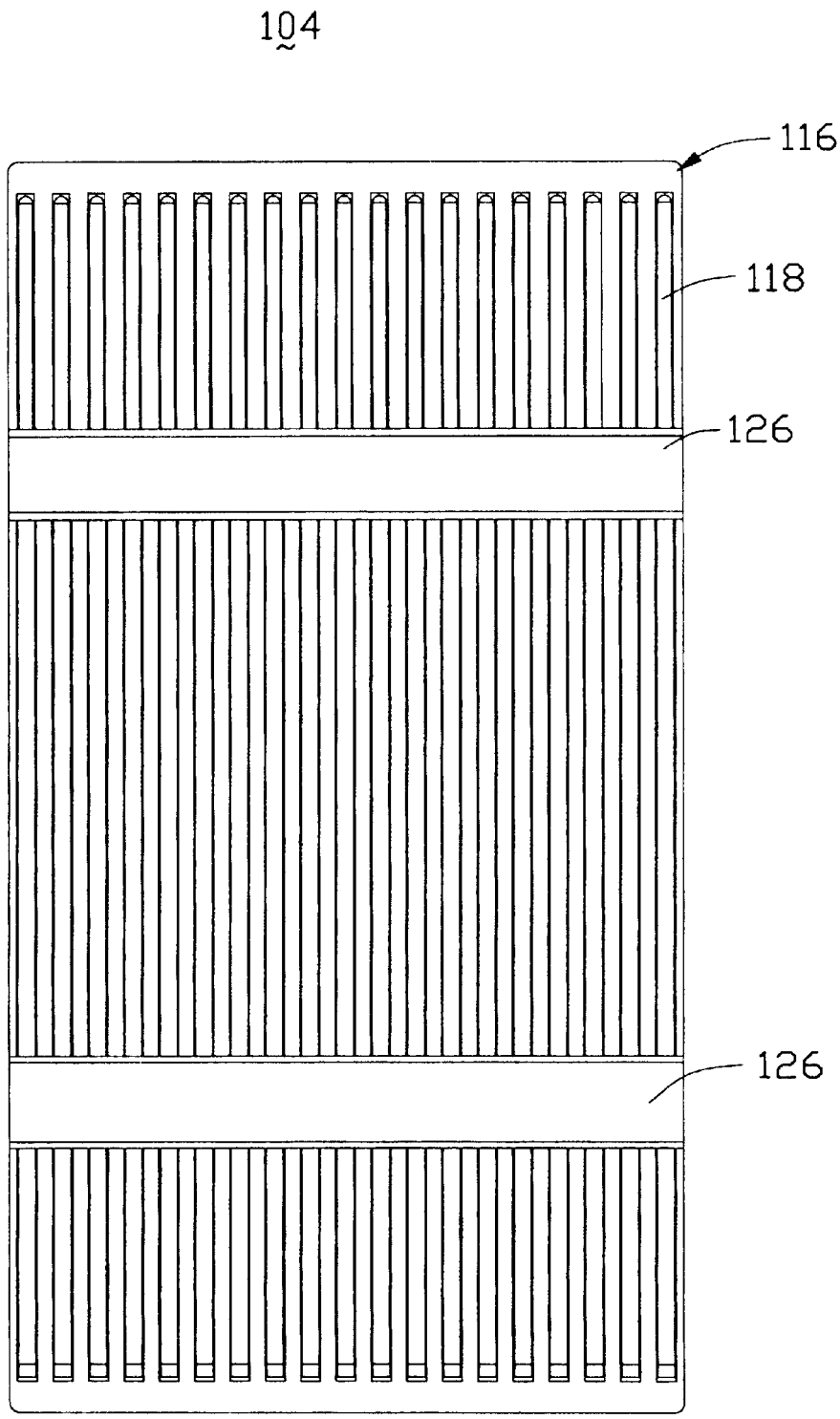
FIG. 20 is a view similar to FIG. 19 but showing an opposite of the terminal module.

Referring to FIGS. 12 and 13, the first extender of a second embodiment 18' is illustrated. The first extender 18' of the second embodiment is different from that of the first embodiment by providing a bar 63 in one or two of the first and the second mating port 64', 66' so as to, after mating with the first and the second electrical connector 14, 16 mounted onto the first and the second PCB 10, 12, separate the first PCB 10 a further distance from the second PCB 12. The bar is preferably variable from zero to 0.060 inches.

Referring to FIGS. 14–20, the first extender of a third embodiment 100 includes an insulative body 102 and a plurality of terminal modules 104 attached to the insulative body 102 in two rows. The insulative body 102 defines two mating ports 106, 108 in upper and lower portions thereof and forms an isolator 110 between the mating ports 106, 108. The isolator 110 defines a plurality of slots 112 where the terminal modules 104 are respectively received with opposite ends thereof extending into the mating ports 106, 108. The isolator 110 defines a groove 114 at a center thereof which communicates with the lower port 108 but is isolated from the upper port 106. Each terminal module 104 includes a dielectric base 116, a plurality of signal terminals 118 (only one is shown) attached to a surface 122 of the dielectric base 116 and a grounding blade 120 attached to an opposite surface 124 of the dielectric base 116. The dielectric base 116 forms upper and lower bias bars 126, 128 on the surface 122 and three ribs 130 on the opposite surface 124. The upper and lower bias bars 126, 128 extend the whole width thereof in a traverse direction. The ribs 130 are located in a mirror relationship with the upper bias bar 126. The dielectric base 116 defines a plurality of cavities 132 in the surface 122 which travel longitudinally through the upper and lower bias bars 126, 128 and to the opposite surface 124 under the upper and lower bias bars 126, 128 to form a plurality of passages 129. The grounding blade 120 is stamped from a metal sheet and defines three openings 134 in accordance with the ribs 130 of the dielectric base and two tabs 136 at a lower portion thereof.

The signal terminals 118 are assembled into the cavities 132 of the dielectric base 116 from the lower portion of the dielectric base 116. As is clearly shown in FIGS. 16–17, the signal terminals 118 are slantly inserted along the cavities 132 through the lower and upper bias bars 128, 126 until the signal terminals 118 are adequately received in corresponding cavities 132. The lower and upper bias bars 128, 126 each provide an inclined surface 140 and the base 116 provides a slant guiding surface 138 at a section of each cavity 132 adjacent the bias bar for facilitating the insertion of the terminals. The grounding blade 120 is then attached to the opposite surface 124 of the dielectric base 116 with the ribs 130 fixedly received in corresponding openings 134 and the tabs 136 extending away from the dielectric base 116. The terminal modules are then downwardly inserted into corresponding slots 112 of the dielectric base 116 with the tabs 136 engaging with the isolator 110.

As another aspect of this invention, an electrical system includes a number of printed circuit boards (PCBs), a same number of electrical connectors and a half number of extenders provided in sets. Footprints on the PCBs are exactly the same and the electrical connector are also exactly the same. The extenders have a same configuration but may be of various heights. Each set includes two PCBs, two electrical connectors mounted onto respective PCBs and one extender located between and electrically engaging with the electrical connectors. The extender of one set is engageable with the electrical connectors of this and any other sets. So, there are sets whose PCBs are separated various distances from each other by particular extenders.

A method of establishing electrical connection between two separate printed circuit boards and accommodating various distances between the two separate printed circuit boards is also disclosed above and should be covered by the claims.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the term in which the appended claims are expressed.

What is claimed is:

1. An assembly of electronic components comprising:

a first and a second printed circuit board;

a first and a second electrical connector electrically mounted onto the first and the second printed circuit board, respectively; and a first and a second extender having various heights, the first and the second extender each including an insulative body defining at least one slot and at least one terminal module engageably received in the at least one slot, the at least one terminal module having an insulative base and a plurality of terminals assembled to the insulative base prior to assembling to the insulative body;

wherein the first and the second extender are selectively one at a time located between and electrically engaged with the first and the second electrical connector, and wherein a particular one of the first and the second extender mated with the first and the second electrical connector defines a distance between the first and the second printed circuit board that is different from a distance defined by the other of the first and the second extender; wherein each terminal module includes a grounding blade attaching to a surface of the insulative base other than a surface that the terminals are assembled to; wherein each insulative base includes at least one bias bar on a surface thereof that the terminals are assembled to, the at least one bias bar having an inclined plane bearing against an oblique peripheral wall of the at least one slot of the insulative body; wherein each insulative base includes at least one rib on a surface thereof opposing the surface that the terminals are assembled to, the at least one rib residing in a notch defined in the insulative body; wherein the first and the second extender each defines two same mating ports in an upper and a lower surfaces thereof for engaging with the first and the second connector, respectively.

2. The assembly of electronic components as claimed in claim 1, wherein the first and the second printed circuit board each has a plurality of conductive interconnects and the first and the second connector each has a plurality of contacts contacting corresponding conductive interconnects, the terminals of one of the first and the second extender connecting the contacts thereby establishing electrical circuit between the first and the second printed circuit board.

3. The assembly of electronic components as claimed in claim 2, wherein the first connector includes an insulative housing defining a plurality of cavities communicating with each other at portions away from the first printed circuit board.

4. The assembly of electronic components as claimed in claim 3, wherein some of the contacts of the first connector are signal contacts and the others are grounding contacts, each cavity receiving one signal contact and one grounding contact spaced from each other in the cavity in a transection of the first connector.

5. The assembly of electronic components as claimed in claim 4, wherein the grounding contacts of the first connector are arranged in two rows and tails of the two rows of grounding contacts in a same transverse section of the first connector are attached to each other and contact a same conductive interconnect on the first printed circuit board.

6. The assembly of electronic components as claimed in claim 1, wherein the first and the second connector are identical.

* * * * *